US006305030B1

(12) United States Patent
Brignone

(10) Patent No.: US 6,305,030 B1
(45) Date of Patent: Oct. 23, 2001

(54) CRASH HELMET FOR SPORTS, IN PARTICULAR CYCLING

(75) Inventor: Alberto Brignone, Meina (IT)

(73) Assignee: Brico S.r.l., Dormelletto (IT)

( * ) Notice: Subject to any disclaimer, the term of this patent is extended or adjusted under 35 U.S.C. 154(b) by 0 days.

(21) Appl. No.: 09/674,846

(22) PCT Filed: May 7, 1999

(86) PCT No.: PCT/IB99/00824

§ 371 Date: Nov. 7, 2000

§ 102(e) Date: Nov. 7, 2000

(87) PCT Pub. No.: WO99/46095

PCT Pub. Date: Nov. 18, 1999

(30) Foreign Application Priority Data

May 8, 1998 (IT) ..... B098A0297

(51) Int. Cl.[7] ..... A63B 71/10
(52) U.S. Cl. ..... 2/425
(58) Field of Search ..... 2/425, 171.3, DIG. 1

(56) References Cited

U.S. PATENT DOCUMENTS

| | | | |
|---|---|---|---|
| 3,925,821 | * | 12/1975 | Lewicki . |
| 4,555,816 | * | 12/1985 | Broersma . |
| 4,599,752 | | 7/1986 | Mitchell . |
| 4,653,123 | | 3/1987 | Broersma . |
| 4,903,350 | | 2/1990 | Gentes et al. . |
| 5,272,773 | * | 12/1993 | Kamata . |
| 5,450,631 | * | 9/1995 | Egger . |
| 5,619,756 | | 4/1997 | Garneau . |
| 5,833,796 | * | 11/1998 | Matich . |

FOREIGN PATENT DOCUMENTS

| | | | |
|---|---|---|---|
| 8525295.6 | | 9/1985 | (DE) . |
| 5-44102 | * | 2/1993 | (JP) . |
| WO 91/05489 | | 5/1991 | (WO) . |
| WO 98/46095 | | 10/1998 | (WO) . |

* cited by examiner

*Primary Examiner*—Rodney M. Lindsey
(74) *Attorney, Agent, or Firm*—Browdy and Neimark

(57) ABSTRACT

A crash helmet (1) for sports, such as cycling, in which, to optimize ventilation for the wearer and so minimize the effects of sweating, the crash helmet consists of a supporting cap (2), designed to be worn on the top of a person's head, and an outer cap (3) designed to fit on top of the supporting cap (2) and permanently connected to the latter; the supporting cap (2) has a plurality of first through holes (5–9) in channels which are opposite the inner surface of the outer cap (3); the front of the outer cap (3) has at least second through holes (18, 19, 20) which communicate with a channel in the supporting cap, and with a first hole (5–9) in the supporting cap; the rear zones of the caps (2,3) together form, at the channels in the supporting cap, an equal number of matching passages (27, 28, 29) which communicate with corresponding second hole (18, 19, 20) and are open at a rear zone of the crash helmet (1); thus between the supporting cap (2) and the outer cap (3), there is a system of channels with Venturi effect, communicating with the head of the crash helmet wearer.

10 Claims, 5 Drawing Sheets

Figure 3:
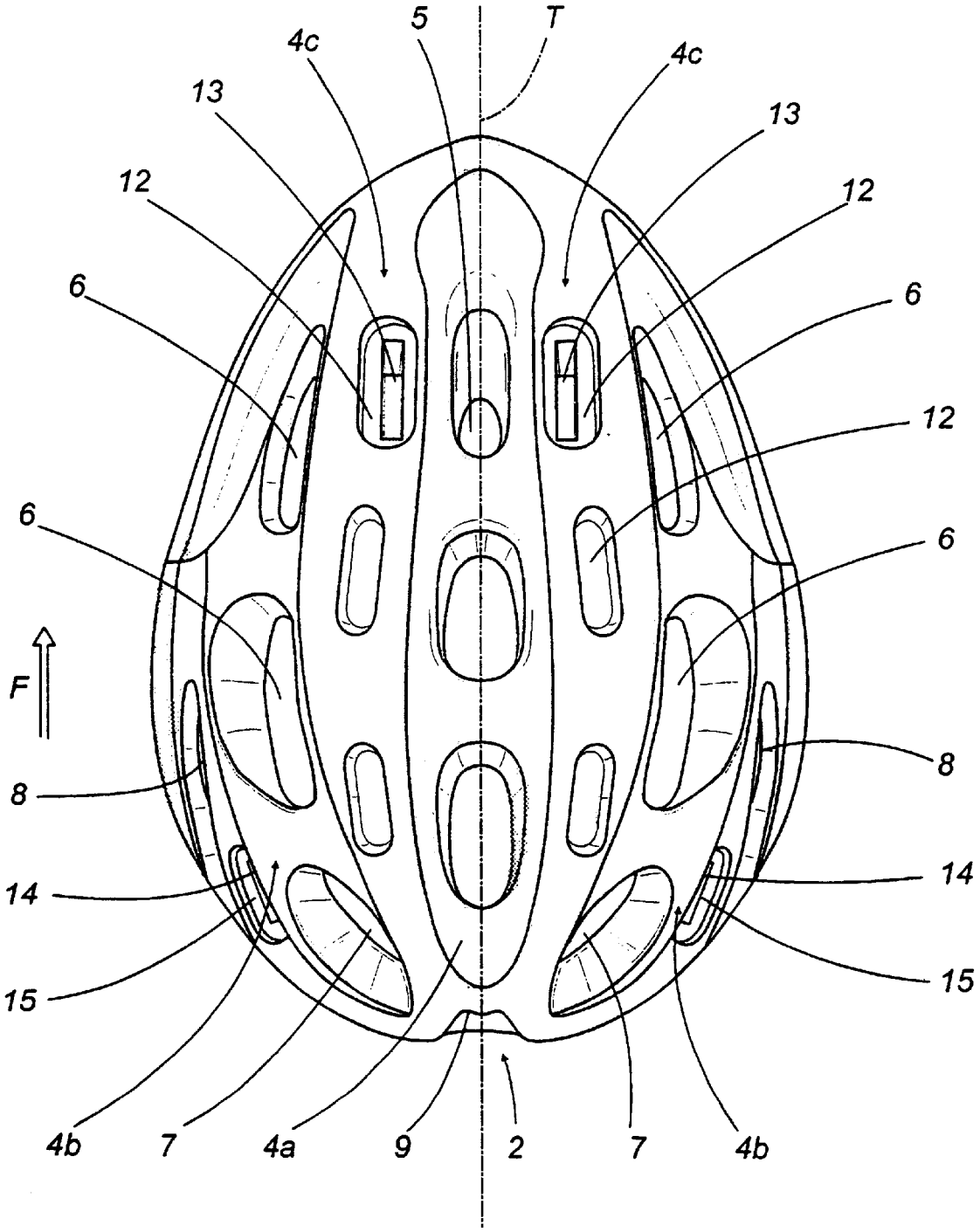

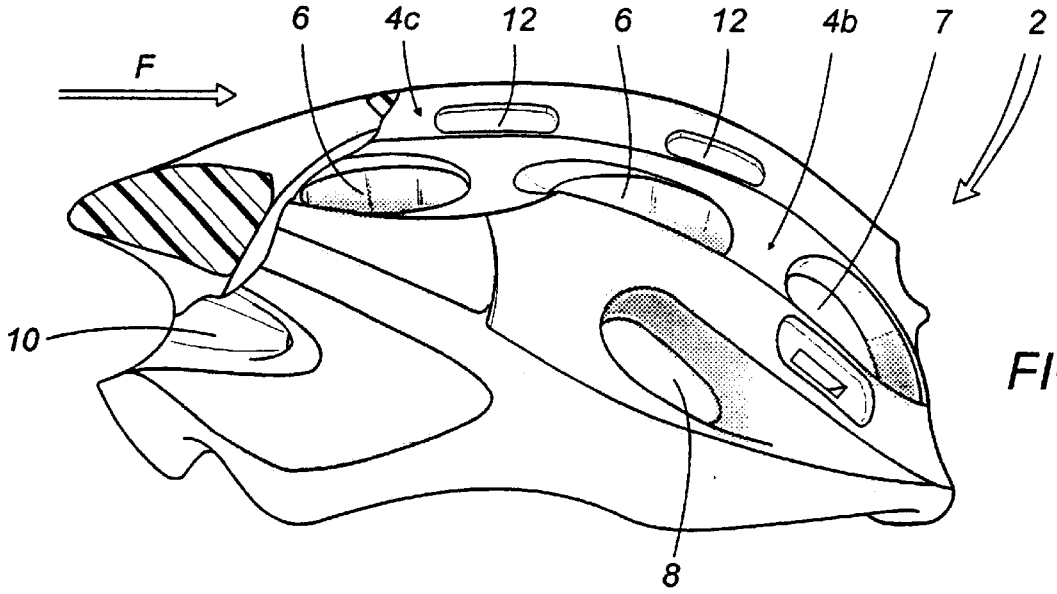
FIG. 1
FIG. 2
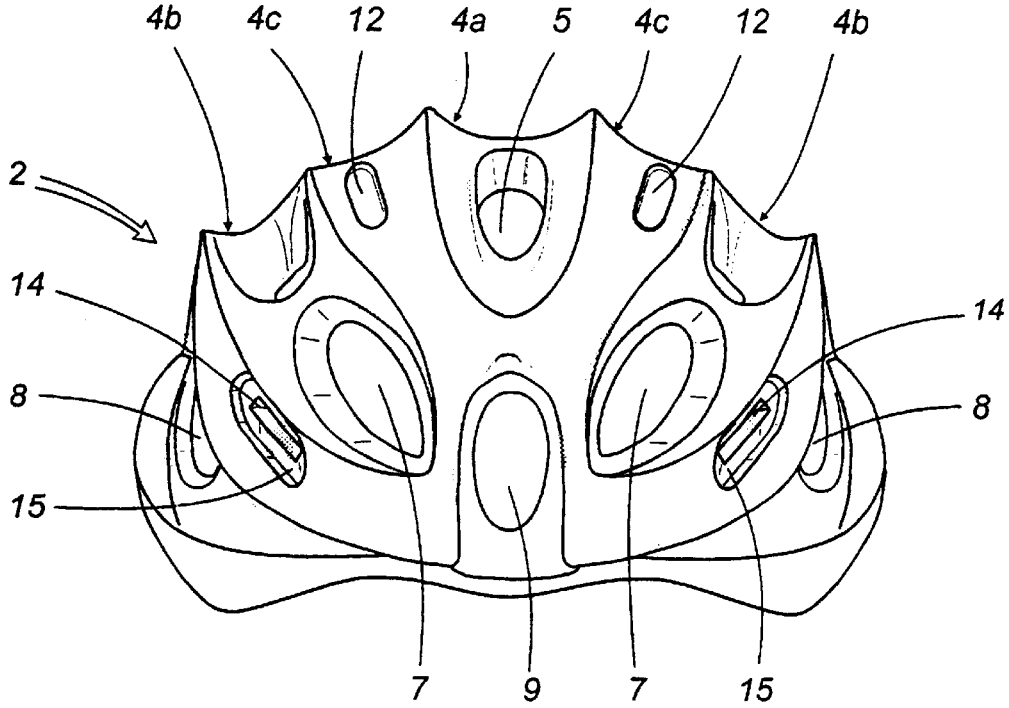

CRASH HELMET FOR SPORTS, IN PARTICULAR CYCLING

The present application is the national stage under 35 U.S.C. 371 of PCT/IB99/00824, filed May 7, 1999.

TECHNICAL FIELD

The present invention relates to a crash helmet for sports. In particular, the present invention relates to a crash helmet which can be used by cyclists.

BACKGROUND ART

Conventional crash helmets for cyclists usually consist of a cap designed to be worn on the top of the head and having a plurality of holes designed to allow air to pass through the wearer's hair. Said air flow is intended to cool the top of the wearer's head, promoting the evaporation of sweat.

It has been noticed that, in the conventional crash helmets of this type, air flows through the hair at a relatively low speed and so does not always guarantee achievement of the above-mentioned arm.

Moreover, the presence of said plurality of holes in the surface of the cap means that the crash helmet does not have optimum aerodynamic characteristics, and so is not ideal for use in competitions.

U.S. Pat. No. 4,653,123 discloses A crash helmet for sports, comprising a supporting cap, being designed to be worn on the top of the head, and an outer cap, designed to fit on top of the supporting cap and be connected to the latter; said supporting cap having a plurality of first through holes in a surface substantially opposite an inner surface of the outer cap, and the outer cap having, at a zone being at the front when in use, at least one second hole for the entering of the air; the rear zones and each other opposed zones of the caps together defining at least one first passage for the exiting of the air at the rear zone of the crash helmet.

DISCLOSURE OF THE INVENTION

The aim of the present invention is, therefore, to overcome the above-mentioned disadvantages and provide a crash helmet for sports which, as well as being very strong and aerodynamic, guarantees optimum ventilation for the top of the wearer's head.

The idea on which the crash helmet disclosed by the present invention is based, as described in the claims herein, envisages the structure of the crash helmet consisting of a supporting cap, designed to be worn on the top of the head, and an outer cap, designed to be worn on top of the supporting cap and presently connected to the latter. To allow optimum ventilation for the crash helmet wearer's head, the supporting cap has a plurality of first through holes in hollows or channels in the outer surface of the supporting cap, facing the inner surface of the outer cap. The front of the outer cap has at least second through holes, each communicating with a relative channel in the supporting cap, and each also communicating with a relative first hole in the supporting cap. The rear zones of the supporting and outer caps together define, at the hollows or channels in the supporting cap, an equal number of matching passages which are open at a rear zone of the crash helmet, so that between the supporting and outer caps with said first and second holes and the channels in the supporting cap, there is a system of channels with Venturi effect, communicating with the internal environment defined by the supporting cap and, therefore, with the crash helmet wearer's head.

Figure 4:
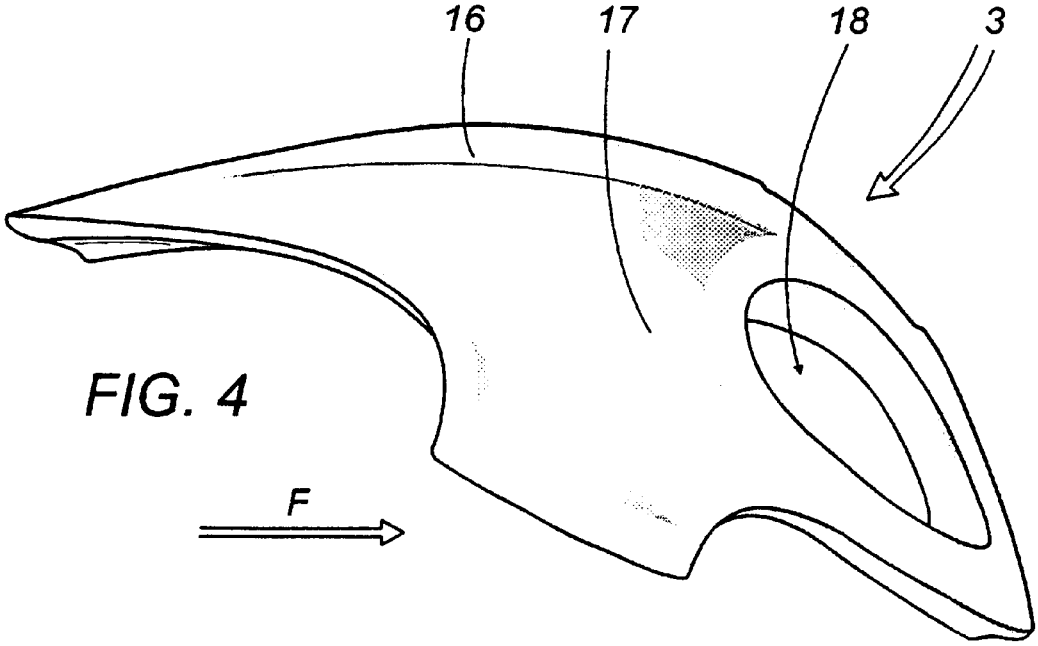
Figure 5:
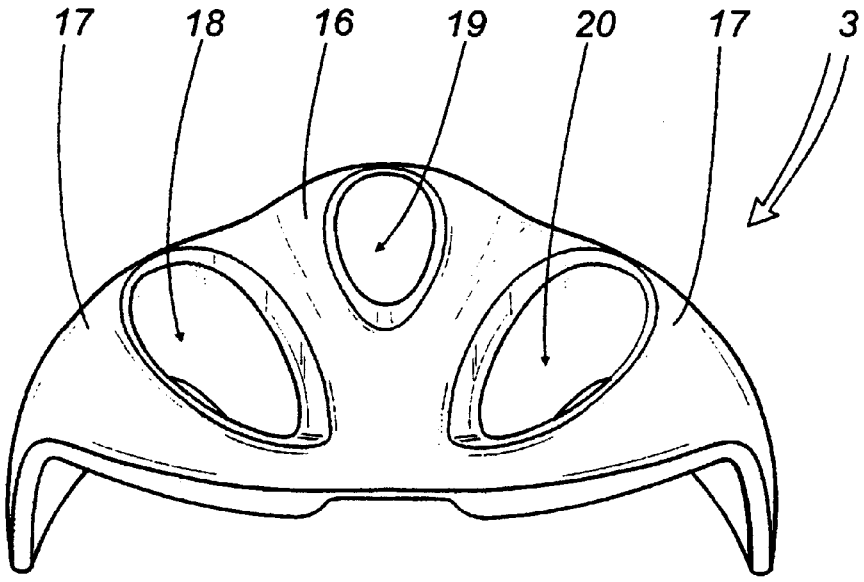
Figure 6:
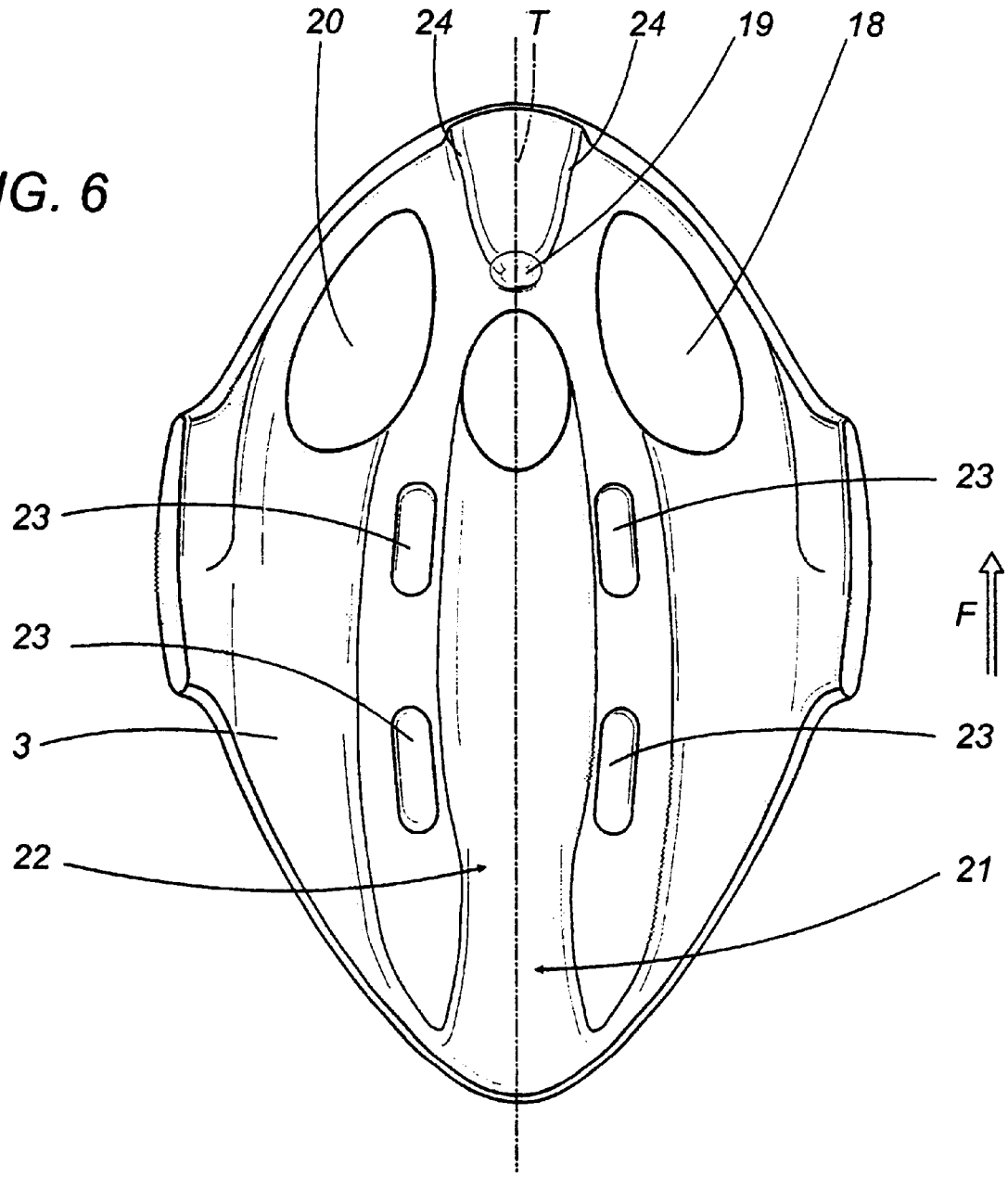
Figure 7:
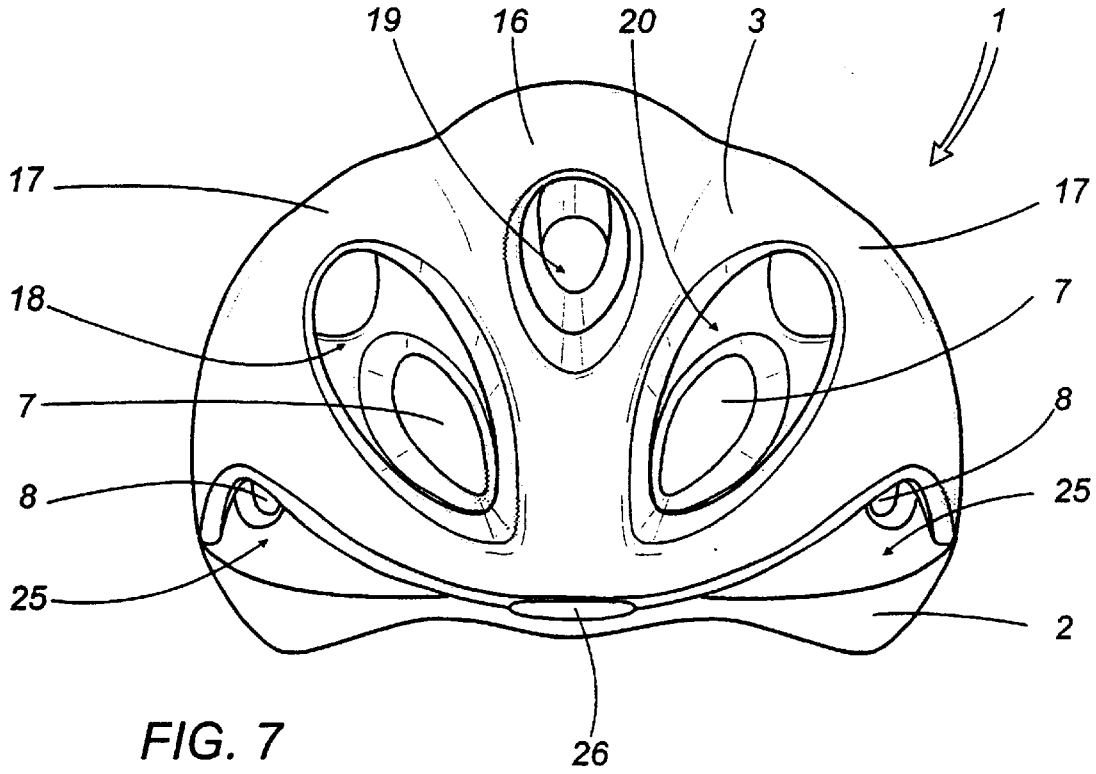
Figure 8:
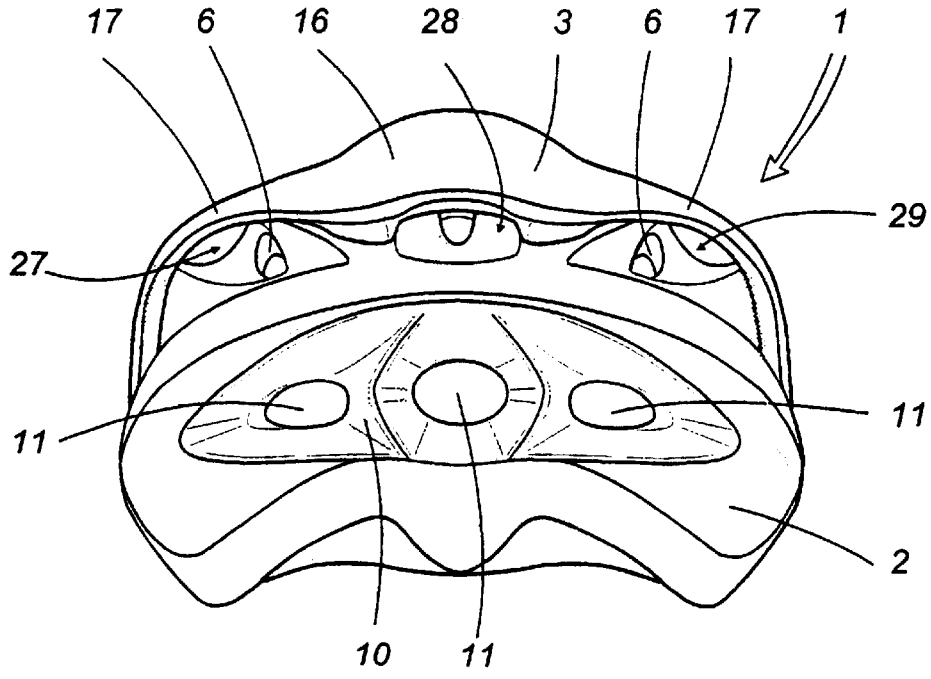

The technical features and the advantages of the crash helmet for sports disclosed, in accordance with the above-mentioned aims, are more clearly illustrated in the detailed description which follows, with reference to the accompanying drawings, which illustrate a preferred embodiment without limiting the scope of application, and in which:

FIGS. 1, 2 and 3 are respectively a side view, a front view and a top plan view of the supporting cap which forms a crash helmet for sports made in accordance with the present invention;

FIGS. 4, 5 and 6 are respectively a side view, a front view and a bottom plan view of the outer cap which, together with the supporting cap in FIGS. 1, 2 and 3, constitutes the crash helmet for sports made in accordance with the present invention; and FIGS. 7 and 8 are respectively an elevated front view and an elevated rear view of a crash helmet for sports made in accordance with the present invention.

With reference to the accompanying drawings and in particular FIGS. 7 and 8, the crash helmet disclosed is labelled 1 as a whole. Said crash helmet 1 comprises a supporting cap 2, designed to be worn on the top of the head, and an outer cap 3, designed to be stably (permanently) connected to an upper surface of the cap 2 during the manufacture of the crash helmet 1.

As illustrated, in particular in FIGS. 1, 2 and 3, the supporting cap 2 is substantially cup-shaped, the concave portion pointing downwards in use. Said cap 2 extends longitudinally in a direction indicated by the arrow F in FIGS. 1 and 3, and consists of two halves which are symmetrical about a plane perpendicular to the plane on which the crash helmet rests in FIG. 3. A straight line representing this plane, parallel with the arrow F is labelled T.

In the description which follows, terms such as "upper", "lower", "front", "rear", "side" and other similar adjectives. indicating a precise position are used with reference to zones of the crash helmet 1 or caps 2 and 3 which, when the crash helmet 1 is worn, are respectively located at the top, at the front, at the rear, at the side, etc.

The upper and side surfaces of the supporting cap 2 have a plurality of long, shallow hollows (or channels), extending longitudinally in directions substantially parallel with the midplane T. Said hollows include a central hollow 4*a*, in an upper zone of the cap 2, with three through holes 5, distributed in a substantially even fashion along the central hollow 4*a*, as well as two hollows 4*b* in respective side zones of the cap 2, each having one hole 7 and two through holes 6, arranged one after another along the hollow 4*b*, the first hole 7 being in a front zone of the hollow 4*b* and the others 6 in a rear zone of the hollow 4*b*.

Two side zones of the cap 2, respectively below the hollows 4*b*, have through holes 8 in a front zone of the cap 2.

A front portion of the cap 2 has a long through hole 9, extending vertically along the midplane T.

A rear zone of the cap 2 has a recessed cavity 10, extending horizontally, in which there are three through holes 11, one in a central zone intersecting the midplane T, and the other two on sides horizontally opposite relative to said plane.

Two hollows 4*c*, respectively between hollow 4*a* and hollows 4*b*, each have three recesses 12, distributed in a substantially even fashion along the relative hollow 4*c*. In each hollow 4*c*, the recess 12 close to a rear zone of the cap 2 is passed through by a hole 13 which extends parallel with the arrow F, designed to house, in a known way, not illustrated, a belt (also not illustrated) which can be used to fasten the crash helmet 1 on the wearer's head. Two similar holes 14, with the same purpose as the holes 13, are made in an equal number of recesses 15 respectively located below the holes 7.

As illustrated, in particular in FIGS. 4, 5 and 6, the outer cap 3 extends longitudinally in the direction indicated by the arrow F, and consists of two halves which are symmetrical about the midplane T. Observed from the front, it can be seen that said outer cap 3 has a three-lobed configuration (FIG. 5), defined by a central projection 16 longitudinally intersected by the midplane T, and two domed zones 17, on opposite sides of the central projection 16.

The outer cap 3 is substantially cup-shaped, with a concave portion which, in use, points downwards, and a front portion which has three through holes 18, 19, 20 (FIGS. 5–7), one located in an upper central zone intersecting the midplane T, and the other two on sides which are horizontally opposite relative to said plane.

As becomes clear later in the present text, when, during the manufacture of the crash helmet 1, the outer cap 3 is fitted onto the supporting cap 2, the central hole 19 is substantially opposite the front hole 5, whilst side holes 18 and 20 are respectively opposite one of the holes 7.

As illustrated, in particular in FIG. 6, at the central projection 16, the inner surface of the cap 3 defines a cavity 21 which extends between the hole 19 and a portion of the rear edge of the cap 3. At its longitudinally central portion, said cavity 21 has a zone with a cross-section which is smaller than the cross-section of the other zones of the cavity 21, forming a constriction 22, the function of which is described below.

Moreover, at the zones which connect the central projection 16 to a domed zone 17, the inner surface of the outer cap 3 has two projections 23, designed so that when the outer cap 3 is fitted to the supporting cap 2, they fit into the respective recesses 12 in the supporting cap 2.

A portion of the inner surface of the cap 3 close to the front edge of the cap 3 has a groove 24 which extends vertically along the plane T. When the caps 2 and 3 are attached to one another to create the assembled crash helmet 1, the groove 24 is opposite the through hole 9 in the supporting cap 2.

Finally, where the supporting cap 2 and outer cap 3 make contact with one another at the front of the crash helmet 1, they define two passages 25 illustrated in FIG. 7, each communicating with one of the holes 8.

As already indicated, the crash helmet 1 is made by placing the outer cap 3 on top of the supporting cap 2, with the projections 23 inserted in the respective recesses 12, and by connecting the caps together stably, for example, by gluing.

When the crash helmet 1 is used, air enters the crash helmet 1 through the holes 18, 19 and 20 in the outer cap 3 (FIG. 5), through the passages 25 and the hole 26 (FIG. 7) defined by placing the groove 24 in the zone of the crash helmet 1 with the hole 9, and flows in the holes 5, 7, 8 and 9 in the supporting cap 2, passing over and through the wearer's hair, cooling the top of the head and allowing the constant evaporation of sweat. Said air exits the crash helmet 1 not only through the holes 11 illustrated in FIG. 8, but also through three passages, labelled 27, 28 and 29, from left to right in FIG. 8, defined at the rear portion of the crash helmet 1 by uniting the respective surfaces of the caps 2 and 3.

It should be noticed that the constriction 22 in the cavity 21 causes the passage 28 to have a zone with a smaller cross-section than the other zones of the passage 28. Said passage 28, therefore, substantially has the shape of a Venturi tube, at the outfeed of which air flows faster than the air which entered through the holes 18, 19, 20 and 26.

As a result, the air which passed over the hair of the person wearing the crash helmet 1 exits the crash helmet 1 very easily, guaranteeing effective circulation of air against the person's head.

It should also be noticed that the portions of the inner surface of the outer cap 3 which constitute said domed zones 17 may be made in such a way as to define, together with the matching outer surfaces of the supporting cap 2, passages (not illustrated) with the functional characteristics of the passage 28.

The crash helmet 1, therefore, fulfils the aims indicated, since as well as being very strong and having an aerodynamic configuration, it can guarantee perfect ventilation for the top of the wearer's head.

The present invention may be subject to numerous modifications and variations, all encompassed by the design concept.

For example, the outer cap 3 may not be designed to be stably fixed, during the manufacture of the crash helmet 1, to the supporting cap 2; in which case, the connection could be made by the user, with conventional connecting means, not illustrated, only when required and, for example, according to the weather conditions.

What is claimed is:

1. A crash helmet for sports, comprising a supporting cap (2), being designed to be worn on the top of the head, and an outer cap (3), designed to fit on top of the supporting cap (2) and be connected to the latter; said supporting cap (2) having a plurality of first through holes (5–9) in a surface substantially opposite an inner surface of the outer cap (3), and the outer cap having, at a zone being at the front when in use, at least one second hole (18, 19, 20) for entry of air; each of said caps having a rear zone and the rear zones of the caps defining at least one first passage (28) defining a path for the exiting of air, characterized in that said at least one first passage (28) has first, second and third successive portions spaced apart along the path, each portion has a cross-section, the second portion is interposed between the first and third portions and the cross-section of the second portion is smaller than the cross-sections of the first and third portions of the first passage.

2. The crash helmet according to claim 1, characterized in that the outer cap (3) has a plurality of second holes (18, 19, 20); the rear zones of the caps (2, 3) together defining a number of said first passages (27, 28, 29) for exiting of the air.

3. The crash helmet according to claim 2, characterised in that there are three second holes (18, 19, 20) and first passages (27, 28, 29).

4. The crash helmet according to claim 3, characterised in that a second hole (19) is located at the centre of a front zone of the outer cap (3); there being two more second holes (18, 20) on opposite sides of the second hole (19).

5. The crash helmet according to claim 1, characterized in that, where they make contact with one another at the front of the crash helmet (1), the supporting cap (2) and outer cap (3) define another hole (26) communicating with a hole (9) in the supporting cap through a groove (24) in the outer cap (3).

6. The crash helmet according to claim 1, characterised in that the supporting cap (2) has at least one third hole (11), being located in a rear zone of the supporting cap below the first passages (27, 28, 29).

7. The crash helmet according to claim 6, characterised in that there are three third holes (11).

8. The crash helmet according to claim 1, characterised in that, at the surface substantially opposite the inner surface of the outer cap (3), the supporting cap (2) has a plurality of recesses (12); said inner surface of the outer cap (3) having a plurality of projections (23) designed to fit into the recesses (12).

9. The crash helmet according to claim 1, characterised in that, if observed from the front, the outer cap (3) has a three-lobed shape.

10. The crash helmet according to claim 1, characterised in that when the crash helmet (1) is assembled, the supporting cap (2) and outer cap (3) are permanently connected to one another.

* * * * *